US008646712B2

(12) United States Patent
Johansson

(10) Patent No.: US 8,646,712 B2
(45) Date of Patent: Feb. 11, 2014

(54) DUST SEAL FOR GYRATORY CRUSHER

(75) Inventor: Henrik Johansson, Malmö (SE)

(73) Assignee: Sandvik Intellectual Property AB, Sandviken (SE)

( * ) Notice: Subject to any disclaimer, the term of this patent is extended or adjusted under 35 U.S.C. 154(b) by 311 days.

(21) Appl. No.: 13/098,689

(22) Filed: May 2, 2011

(65) Prior Publication Data

US 2011/0290925 A1 Dec. 1, 2011

(30) Foreign Application Priority Data

May 3, 2010 (SE) ..... 1050437

(51) Int. Cl.
*B02C 2/00* (2006.01)

(52) U.S. Cl.
USPC ..... 241/216; 241/207

(58) Field of Classification Search
USPC ..... 241/207–216; 277/634–635
See application file for complete search history.

(56) References Cited

U.S. PATENT DOCUMENTS

| | | | | | |
|---|---|---|---|---|---|
| 463,911 | A | * | 11/1891 | McCully | 241/213 |
| 2,134,876 | A | | 11/1938 | Hull et al. | |
| 2,134,885 | A | | 11/1938 | Newhouse et al. | |
| 2,656,120 | A | * | 10/1953 | Roubal | 241/202 |
| 3,384,312 | A | * | 5/1968 | Patterson et al. | 241/208 |
| 3,417,932 | A | * | 12/1968 | Patterson | 241/208 |
| 3,473,743 | A | | 10/1969 | Winter | |
| 3,782,647 | A | * | 1/1974 | Decker et al. | 241/215 |
| 4,179,076 | A | * | 12/1979 | Barrot et al. | 241/216 |
| 4,391,414 | A | * | 7/1983 | Reiter | 241/213 |
| 4,436,314 | A | * | 3/1984 | Vossieck | 277/379 |
| 5,803,382 | A | | 9/1998 | Ganser, IV et al. | |
| 6,328,237 | B1 | | 12/2001 | Thysell | |
| 7,673,821 | B2 | * | 3/2010 | Norrman et al. | 241/15 |
| 7,845,237 | B2 | * | 12/2010 | Torres et al. | 73/821 |
| 7,988,082 | B2 | * | 8/2011 | Norrman et al. | 241/211 |
| 2002/0088886 | A1 | * | 7/2002 | Zortman et al. | 241/207 |

FOREIGN PATENT DOCUMENTS

| | | |
|---|---|---|
| GB | 555309 | 8/1943 |
| SE | 532 646 | 3/2010 |

OTHER PUBLICATIONS

International Search Report issued on Jul. 1, 2011 in related International Application No. PCT/SE2011/050486 filed Apr. 20, 2011.

* cited by examiner

*Primary Examiner* — Dana Ross
*Assistant Examiner* — Leonel Vasquez
(74) *Attorney, Agent, or Firm* — Morgan, Lewis & Bockius LLP

(57) ABSTRACT

Gyrator crusher has a crusher head on which a first crushing shell is mounted, a frame on which a second crushing shell is mounted, the first and second crushing shells forming a crushing aperture. Drive device rotates an eccentric causing the connected crusher head to perform gyratory movement for crushing. Dust seal seals a gap between the frame and a fastening portion situated close to the crusher head and includes a seal bellows and a seal slide ring. Seal slide ring connects sealingly to a lower portion of the seal bellows and has a lower slide surface adapted to slide along, and to sealingly abut, with a substantially vertical abutment pressure, against an upper slide surface on the frame. Upper portion of the seal bellows sealingly connects to the fastening portion so rotation of the crusher head rotates the seal slide ring about a substantially vertical axis of rotation.

13 Claims, 4 Drawing Sheets

DUST SEAL FOR GYRATORY CRUSHER

This application claims priority under 35 U.S.C. §119 to Swedish Patent Application No. 1050437-1 filed on May 3, 2010, which is incorporated by reference herein in its entirety.

FIELD OF THE INVENTION

The present invention relates generally to a gyratory crusher including a crusher head on which a first crushing shell is mounted. A frame is provided on which a second crushing shell is mounted, the second crushing shell forming in conjunction with the first crushing shell a crushing aperture. A drive device is adapted to rotate an eccentric to which the crusher head is so connected as to be adapted, during rotation of the eccentric, to perform a gyratory movement for crushing of material which is introduced into the crushing aperture. A dust seal is adapted to seal a gap between the frame and a fastening portion situated close to the crusher head. The invention relates also to a dust seal for a gyratory crusher, a method of fitting a dust seal in a gyratory crusher and a method of sealing a gap between a frame in a gyratory crusher and a fastening portion situated close to a crusher head.

BACKGROUND OF THE INVENTION

A gyratory crusher of the above-mentioned kind may, for example, be used to crush ore and rock material to smaller sizes.

U.S. Pat. No. 2,134,885 describes such a gyratory crusher. The gap between the crusher head and the frame is sealed against dust by a sealing socket which abuts sealingly against a slide tube associated with the frame of the crusher. The sealing socket is suspended in the crusher head via a rubber skirt which absorbs the eccentric movement of the crusher head in the horizontal plane relative to the slide tube. The dust seal further allows the crusher head to be raised and lowered relative to the frame in that the sealing socket is adapted to slide in the height direction along the slide tube.

A problem with this sealing socket is that it involves lubricant loss. Without lubrication, the frictional resistance between the sealing socket and the slide tube would wear away the rubber skirt in which the sealing socket is suspended. Moreover, a constant flow of lubricant is required to prevent dust from making its way into the clearance which is inevitably present between the sealing socket and the slide tube as a result of normal manufacturing tolerances and wear. The lubricant loss consumes lubricant and contaminates the material being crushed. The dust seal is also expensive and relatively complicated to fit.

An object of the invention is to provide a gyratory crusher in which the above-mentioned disadvantages are reduced or completely eliminated.

SUMMARY OF THE INVENTION

In an embodiment, the invention provides a gyratory crusher including a crusher head on which a first crushing shell is mounted. A frame is provided on which a second crushing shell is mounted, the second shell forming in conjunction with the first crushing shell a crushing aperture. A drive device is adapted to rotate an eccentric to which the crusher head is so connected as to be caused, during rotation of the eccentric, to perform a gyratory movement for crushing of material which is introduced into the crushing aperture. A dust seal is adapted to seal a gap between the frame and a fastening portion situated close to the crusher head. The dust seal includes a seal bellows and a seal slide ring which is connected sealingly to a lower portion of the seal bellows. The seal slide ring has a lower slide surface adapted to slide along, and to sealingly abut, with a substantially vertical abutment pressure determined by the inherent weight of the seal slide ring and by the influence of the seal bellows, against an upper slide surface provided on the frame. An upper portion of the seal bellows is sealingly connected to the fastening portion so that rotation of the crusher head causes rotation of the seal slide ring about a substantially vertical axis of rotation.

In another embodiment, the invention provides a dust seal for sealing a gap in a gyratory crusher between a frame and a fastening portion situated adjacent to a crusher head. The dust seal includes a seal bellows with a first end opening adapted to sealingly connect to a fastening portion situated close to the crusher head and a second end opening to which a seal slide ring is sealingly connected. The seal slide ring has a slide surface which faces away from the seal bellows and is adapted to slide along, and sealingly abut against, a slide surface provided on the frame. A guiding edge, which extends from the seal bellows, runs along the seal slide ring and is adapted to cooperate with a frame slide ring attached to the frame in order to limit transverse movements of the seal slide ring in the plane of the slide surfaces.

In yet another embodiment, the invention provides a method of fitting a dust seal to seal a gap between a frame and a fastening portion situated close to a crusher head in a gyratory crusher. The method includes the steps of applying around a crusher main shaft, which forms part of the crusher, a dust seal including a seal bellows and a seal slide ring that is connected sealingly to a lower portion of the seal bellows and has a lower slide surface. An upper portion of the seal bellows is sealingly connected to the fastening portion situated close to the crusher head. The seal slide ring is aligned relative to the frame so that a guiding protrusion for limiting horizontal transverse movements of the seal slide ring assumes a position which allows the lower slide surface of the seal slide ring to be brought together with the upper slide surface of the frame. The seal slide ring is placed on the upper slide surface of the frame with a substantially vertical abutment pressure determined by the inherent weight of the seal slide ring and by the influence of the seal bellows.

In still another embodiment, the invention provides a method of sealing a gap between a frame and a fastening portion situated close to a crusher head in a gyratory crusher during operation, by using a dust seal including a seal bellows and a seal slide ring which is sealingly connected to a lower portion of the seal bellows. The method includes providing torsionally secure tightness between an upper portion of the bellows and the fastening portion so that the bellows and the seal slide ring are caused to accompany movements of the crusher head. Sliding tightness is provided between a lower slide surface provided on the seal slide ring and an upper slide surface provided on the frame. The seal slide ring is abutted against the upper slide surface of the frame with a sealing force determined by the inherent weight of the seal slide ring and by the influence of the seal bellows. The seal slide ring is guided so that it does not leave the upper slide surface of the frame.

The fact that the abutment pressure is determined by the inherent weight of the seal slide ring and by the influence of the seal bellows limits the friction between the dust seal and the frame and hence also the torsional forces to which the dust seal bellows is subject. The slide surfaces therefore need no lubrication. Constant abutment during operation is also effected between the slide surfaces, which means that the tightness of the dust seal is less sensitive to variations in its manufacturing tolerances and amount of wear. The dust seal is also relatively easy to fit and can fairly easily be made with relatively inexpensive materials and few constituent parts.

Mobility of the seal slide ring in radial directions relative to its axis of rotation is preferably limited by a guiding protrusion so that there is no risk of the seal slide ring sliding off the slide surface of the frame during operation of the crusher. Unnecessary operational stoppages are thereby avoided. According to an embodiment, the slide surface of the frame is situated on a frame slide ring which extends upwards from the frame, and the guiding protrusion takes the form of a guiding edge which runs along the seal slide ring and is concentric with, and extends downwards around, an upper portion of the frame slide ring, so that the frame slide ring and the guiding edge of the seal slide ring cooperate to limit radial movements of the seal slide ring. The guiding edge thus forms a protective collar which hangs down and which ends with a drip edge below the plane of the slide surfaces, so that the risk of dust reaching the slide surfaces is reduced.

Mobility of the seal slide ring in axial directions when the crusher is in operation is preferably limited by a safety element situated above a surface of the seal slide ring, and the vertical distance between the safety element and the seal slide ring is appropriate to prevent the seal slide ring from rising so high that the radially limiting action of the guiding protrusion ceases. The risk of unnecessary operational stoppages being caused by the lower slide surface of the seal slide ring sliding off the upper slide surface of the frame is thus reduced. According to an embodiment, the safety element takes the form of a safety hook which is attached to the frame and pivotable between a lowered service state in which the seal slide ring is free to rise from the frame, and a raised operative state in which the safety hook surrounds an upper surface of the seal slide ring, the safety hook being further provided with a locking device intended to lock the safety hook in the operative state.

According to an embodiment, the width of the crushing aperture is adjustable by adjustment of the working height of the crusher head. On such a crusher, the invention affords the further advantage that the crusher may be of relatively low height since there is no need for a long slide tube capable of accommodating the whole vertical adjustment extent of the crusher head. A low crusher head is of advantage in that material which is to be crushed has first to be lifted in order to be fed into the crushing aperture from above. According to an embodiment, the seal bellows is adapted to accommodate a vertical movement of the crusher head of at least 100 mm with no loss of dust tightness.

According to an embodiment, the seal bellows includes a sealing layer of natural or synthetic rubber. This makes it possible to achieve both great dust tightness and good flexibility of the bellows. According to a preferred embodiment, the seal bellows is tangentially stiffened by reinforcing inserts to ensure its ability to withstand the torsional force exerted by the crusher head. The risk of the bellows becoming deformed when the crusher is set in motion is thereby reduced.

According to an embodiment, the seal slide ring is made of nylon, which has been found not only to have good friction characteristics but also to be highly resistant to wear.

According to another aspect, the problem is reduced by a dust seal for sealing a gap in a gyratory crusher between a frame and a fastening portion situated adjacent to a crusher head, which dust seal includes a seal bellows with a first end opening adapted to sealingly connect to a fastening portion situated close to the crusher head, and a second end opening to which a seal slide ring is sealingly connected and has a slide surface which faces away from the seal bellows and which is adapted to sliding along, and sealingly abutting against, a slide surface provided on the frame, and a guiding edge which extends from the seal bellows, runs along the seal slide ring and is adapted to cooperating with a frame slide ring attached to the frame, in order to limit transverse movements of the seal slide ring in the plane of the slide surfaces. Such a dust seal need not be lubricated and its tightness is less sensitive to variations in manufacturing tolerances and amount of wear. Moreover, the dust seal is easy to fit and can be made fairly easily with relatively inexpensive materials and few constituent parts.

According to a further aspect, the problem is reduced by a method of fitting a dust seal to seal a gap in a gyratory crusher between a frame and a fastening portion situated close to a crusher head, which method includes applying around a crusher head shaft which forms part of the crusher a dust seal which includes a seal bellows and a seal slide ring which is connected sealingly to a lower portion of the seal bellows and has a lower slide surface; connecting an upper portion of the seal bellows sealingly to the crusher head; aligning the seal slide ring relative to the frame so that a guiding protrusion for limiting horizontal transverse movements of the seal slide ring assumes a position which allows the lower slide surface of the seal slide ring to be brought together with the upper slide surface of the frame; and placing the seal slide ring on the upper slide surface of the frame with a substantially vertical abutment pressure determined by the inherent weight of the seal slide ring and by the influence of the seal bellows. This method simplifies the fitting of a dust seal in that the seal slide ring can easily be aligned with the upper slide surface of the frame irrespective of the distance between the crusher head and the upper slide surface of the frame. A seal bellows which is flexible in vertical directions also reduces the risk of pinch accidents during fitting.

The method preferably includes applying, above a surface of the seal slide ring, a safety element to limit vertical movements of the seal slide ring so that it is prevented from rising so high that the horizontally limiting action of the guiding protrusion ceases.

According to a further aspect, the problem is reduced by a method of fitting a dust seal to seal a gap in a gyratory crusher between a frame and a fastening portion situated close to a crusher head, by using a dust seal including a seal bellows and a seal slide ring which is connected sealingly to a lower portion of the seal bellows, which method includes providing torsionally secure tightness between an upper portion of the bellows and the fastening portion, so that the bellows and the seal slide ring are caused to accompany movements of the crusher head; providing sliding tightness between a lower slide surface provided on the seal slide ring and an upper slide surface provided on the frame; abutting the seal slide ring against the upper slide surface of the frame with a sealing force determined by the inherent weight of the seal slide ring and by the influence of the seal bellows; and guiding the seal slide ring so that it does not leave the upper slide surface of the frame. This ensures, during operation of the crusher, constant abutment between the slide surfaces, rendering the tightness of the dust seal less sensitive to variations in its manufacturing tolerances and amount of wear. The limited and self-regulating abutment pressure also results in limitation of the torsional forces to which the dust seal is subject.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
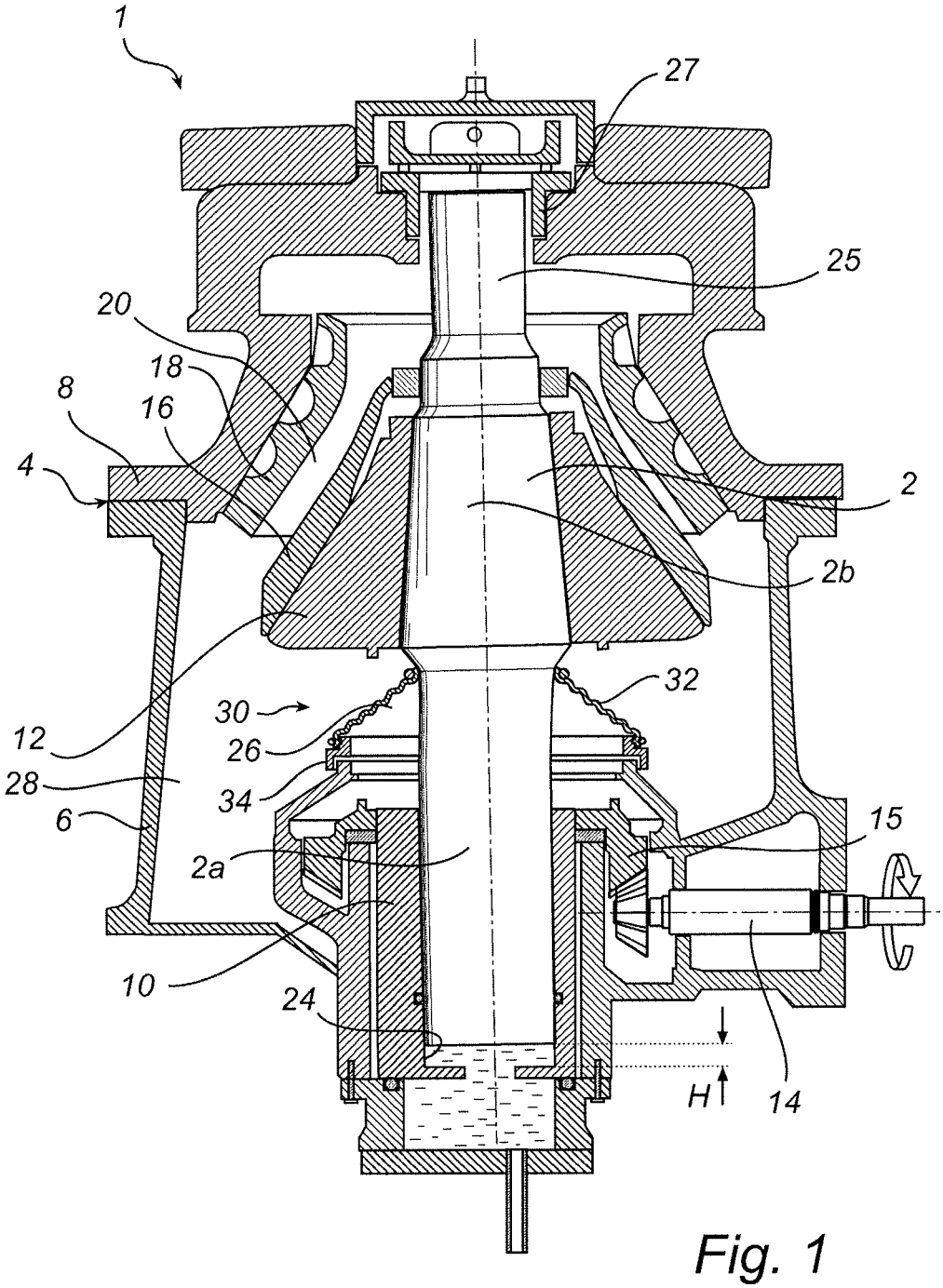
FIG. 1 is a schematic cross-sectional view illustrating a gyratory crusher with a dust seal.

FIG. 1 illustrates schematically a gyratory crusher 1 according to a first embodiment. The gyratory crusher 1 has a vertical crusher main shaft 2 and a frame 4 which includes a frame lower part 6 and a frame upper part 8. An eccentric device in the form of an eccentric 10 is arranged for rotation about a lower portion 2*a* of the crusher main shaft 2 by the lower portion 2*a* being journalled in a circular cylindrical plain bearing 24 in an eccentrically situated recess in the eccentric 10. A crusher head 12 is connected firmly to an upper portion 2*b* of the crusher main shaft 2. A driveshaft 14 is adapted, in conjunction with an undepicted motor, to rotate the eccentric 10 by means of a ring gear 15 mounted on the eccentric 10. The vertical crusher main shaft 2 has its upper end 25 journalled in a top bearing 27 in the frame upper part 8. When the driveshaft 14 rotates the eccentric 10 during operation of the crusher 1, the crusher main shaft 2 and the crusher head 12 mounted on it will perform a gyratory movement.

A first crushing shell 16 is mounted firmly on the crusher head 12. A second crushing shell 18 is mounted firmly on the frame upper part 8. A crushing aperture 20 is thus formed between the two crushing shells 16, 18. Material which is to be crushed is introduced into the crushing aperture 20 and is crushed between the first crushing shell 16 and the second crushing shell 18 as a result of the gyratory movement of the crusher head 12, during which the two crushing shells 16, 18 approach one another along a rotating generatrix and move away from one another along a diametrically opposite generatrix. Since the crusher head 12 is connected rotatably to the eccentric 10, the first crushing shell 16 will, via the material being crushed, roll off towards the second crushing shell 18 and cause the crusher head 12 and the crusher main shaft 2 to slowly rotate relative to the frame 4. When the crushing aperture 20 contains no material to be crushed, the friction between the crusher main shaft 2 and the eccentric 10 will cause the crusher head 12 to rotate at the same speed as the eccentric 10.

The crusher main shaft 2, and hence also the crusher head 12, can be raised and lowered hydraulically relative to the frame 4 in a manner not described in more detail. Various arrangements for raising and lowering the crusher head 12 hydraulically are described in detail in, for example, Swedish Patent No. 532646 and U.S. Pat. No. 6,328,237. The fact that the crusher head can be raised and lowered makes it possible for the width of the crushing aperture 20 to be varied so that the crusher can be set to produce different fractions or particle sizes of crushed material. The vertical adjustment range H of the crusher head 12 is usually at least 100 mm or more, and often between 100 and 500 mm.

To provide dust protection for the bearing 24 of the crusher main shaft 2 in the eccentric 10 and for the bearing of the eccentric 10 in the frame 4, a space 26 around these bearings is separated from a space 28 below the crushing aperture 20 by a dust seal 30. The dust seal 30 includes a seal bellows 32 connected to a seal slide ring 34. The seal bellows 32 is configured to absorb both horizontal and vertical movements. The length of the dust seal 30 is thereby adapted automatically to the working height of the crusher head 12 when the crusher head 12 is raised or lowered. In addition, the upper element of the dust seal 30 accompanies the gyratory and rotary movements of the crusher main shaft 2 with no loss of tightness relative to the frame 4 and the crusher main shaft 2.

Figure 2:
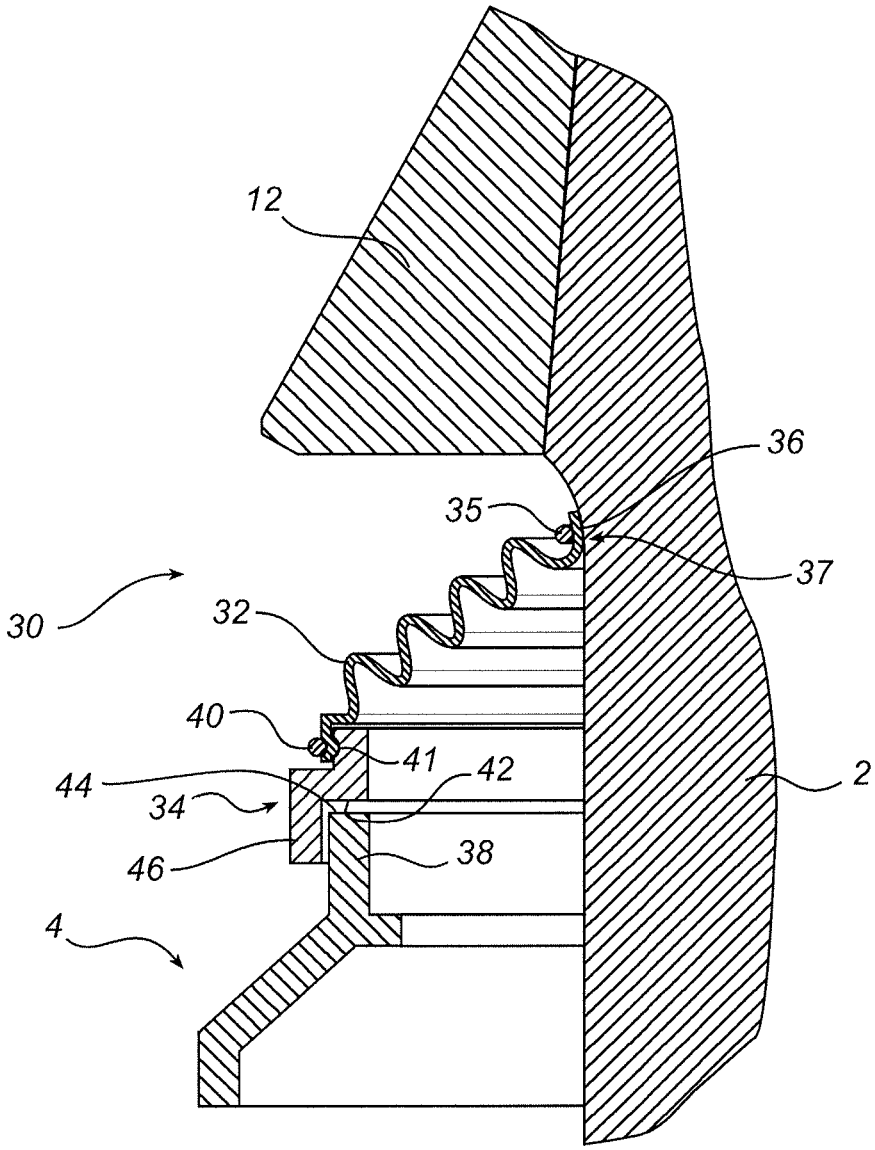
FIG. 2 is a detailed view of the crusher in FIG. 1, showing in more detail the dust seal and its mode of tightness to the crusher head and the frame.

FIG. 2 depicts in a schematic enlarged view the dust seal 30 and the upper parts of the crusher 1 with which it cooperates. The upper element 36 of the dust seal 30 is fastened to a fastening portion 37 close to the crusher head 12; in the example depicted in FIG. 1, the upper element 36 of the seal 30 is fastened to the crusher main shaft 2 by a hose clip 35. The lower element of the dust seal 30, in the form of the seal slide ring 34, rotates with the crusher head 12 and abuts against and slides along a circular cylindrical frame slide ring 38 which is connected firmly to the frame 4. For the sake of clarity, the seal slide ring 34 is shown raised somewhat above the frame slide ring 38.

The seal slide ring 34 is connected to the seal bellows 32 by a hose clip 40. An appropriate groove 41 for the hose clip 40 in the seal slide ring 34 ensures good tensile stability between the seal slide ring 34 and the seal bellows 32. The seal slide ring 34 is further provided with a substantially horizontal lower slide surface 42 which is adapted, when the crusher is in operation, to abut against a substantially horizontal upper slide surface 44 of the frame slide ring 38. A guiding edge 46 serving as a guiding protrusion which limits transverse movements of the seal slide ring 34 in the horizontal plane extends downwards from the seal slide ring 34 and runs around the whole circumference of the frame slide ring 38, which frame slide ring 38 may also be regarded as serving as a guiding protrusion.

Although the seal slide ring 34 in FIG. 2 is shown somewhat raised above the frame slide ring 38, it is intended, when the crusher is in operation, to abut and seal against the frame slide ring 38. Dust tightness is thus provided by the lower slide surface 42 of the seal slide ring 34 abutting by the inherent weight of the seal slide ring 34 against the upper slide surface 44 of the frame slide ring 38. The abutment of the seal slide ring 34 by its inherent weight against the frame 4 achieves good tightness in combination with low friction between the slide surfaces 42, 44. The low friction results in low energy consumption and little wear both on the seal slide ring 34 and on the frame slide ring 38. It also minimizes the risk that the seal slide ring 34 might jam firmly to the frame slide ring 38 with consequent damage to the seal bellows 32. The seal slide ring 34 or its lower slide surface 42 is preferably made of plastic, resulting in low manufacturing cost and low friction. An example of a suitable plastic is nylon.

Figure 3:
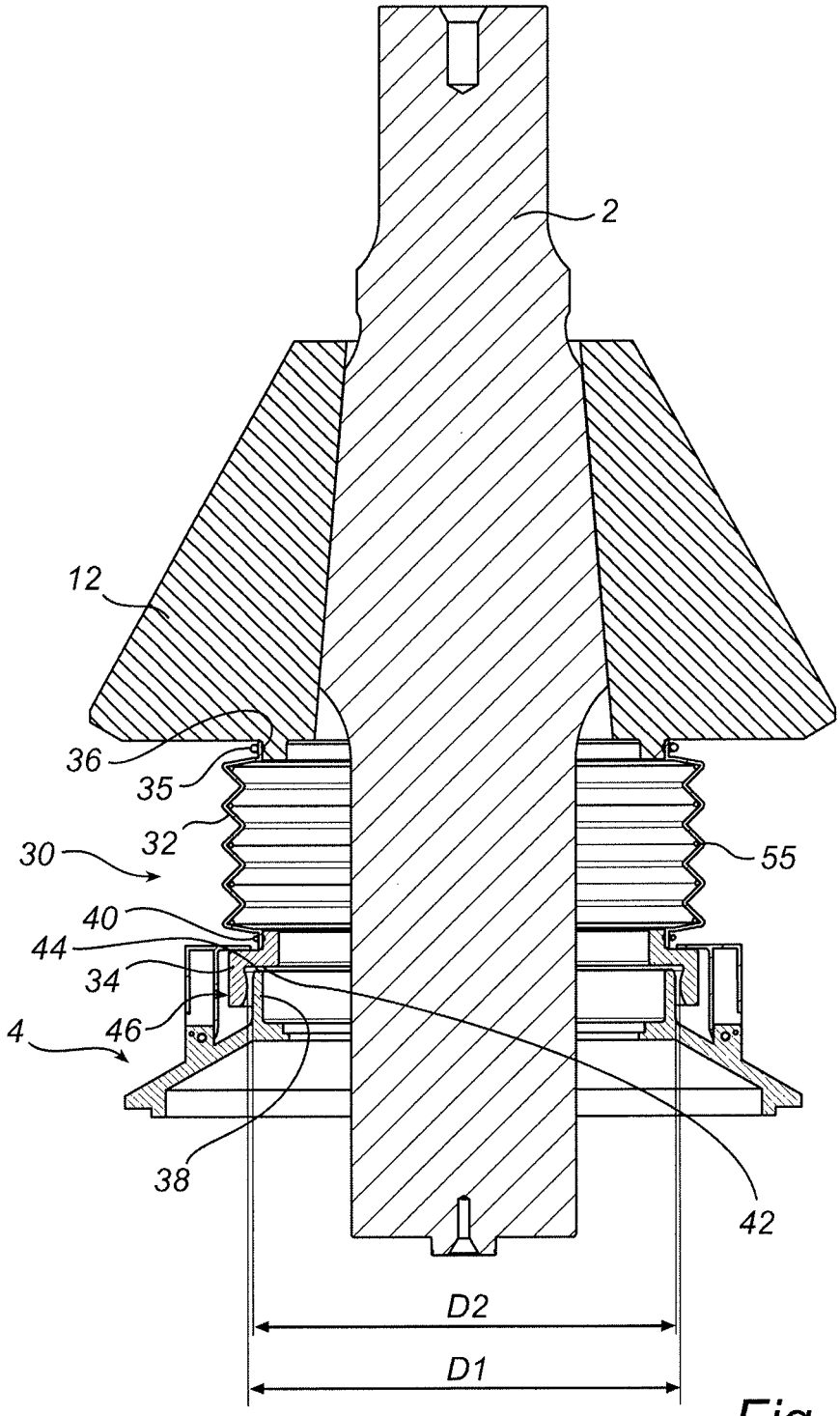
FIG. 3 is a schematic cross-sectional view of part of a gyratory crusher, illustrating an alternative embodiment of a dust seal.

FIG. 3 depicts an alternative embodiment in which the upper element 36 of the dust seal 30 is directly connected to the crusher head 12. This embodiment is particularly suitable for crushers provided with a crusher head 12 which is journalled for rotation relative to the crusher main shaft 2, since the dust seal 30 also provides dust protection for the interface 50 (FIG. 4) between the crusher head 12 and the crusher main shaft 2. This embodiment affords the further advantage that the seal bellows 32 may be purchased as piece goods and be cut to length.

Figure 4:
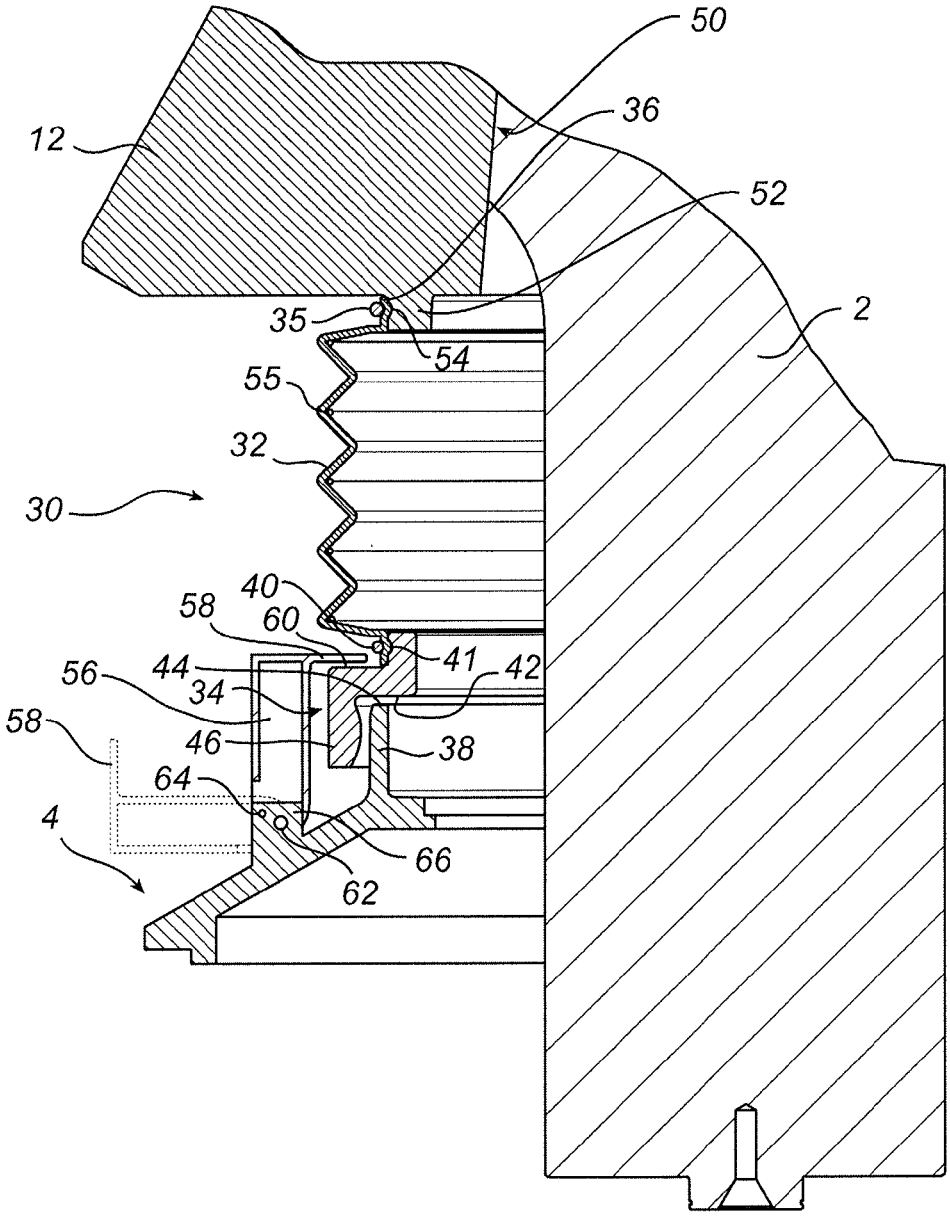
FIG. 4 is a detailed view of the alternative embodiment of a dust seal depicted in FIG. 3 and its mode of tightness to the crusher head and the frame.

FIG. 4 depicts the dust seal 30 and its fastening to the crusher head 12 and the frame 4 in more detail. In the embodiment depicted, the seal bellows 32 is fastened to the crusher head 12 by a hose clip 35 which clamps the seal bellows 32 against a circular flange 52 which extends downwards from the crusher head 12. An appropriate groove 54 for the hose clip 35 is provided in the outer shell surface of the flange 52, thereby increasing the tensile stability of the connection in vertical directions.

To increase the torsional rigidity of the seal bellows 32, i.e. to reduce its flexibility in tangential directions, with respect to its axis of rotation during operation, the seal bellows 32 is provided with stiffening elements in the form of reinforcing inserts 55. The reinforcing inserts 55, which may for example take the form of rings made of metal or hard plastic, run along the circumference of the seal bellows 32. They may for example be moulded integrally with the seal bellows 32 or be firmly vulcanized or taped to the surface of the seal bellows 32.

Although the seal slide ring 34 in FIGS. 3-4 is shown somewhat raised above the frame slide ring 38, it is intended, when the crusher 1 is in operation, to abut and seal against the frame slide ring 38. Dust tightness is ensured by the lower slide surface 42 of the seal slide ring 34 abutting by the inherent weight of the seal slide ring 34 against the upper slide surface 44 of the frame slide ring 38. However, the seal bellows 32 may also, depending on its degree of extension, make a positive or negative contribution to the abutment pressure. This contribution depends on the relationship between the length of the seal bellows 32 at rest and its actual length when the crusher 1 is in operation. For example, the seal bellows 32 may be extended relative to its length at rest by the weight of the seal slide ring 34 pulling the lower portion of the seal bellows 32 downwards. In this case the influence of the seal bellows 32 will be a negative contribution to the abutment pressure of the seal slide ring 34 against the frame 4. Alternatively, the seal bellows 32 may be compressed if its length at rest is longer than the distance between its fastenings to the seal slide ring 34 and the crusher main shaft 2. In this case the influence of the seal bellows 32 will be a positive contribution to the abutment pressure of the seal slide ring 34 against the frame 4. The fact that the seal slide ring 34 abuts by its inherent weight against the frame 4, with only a conditional contribution from the influence of the bellows 32, results in a good seal in combination with low friction between the slide surfaces 42, 44. The low friction results in low energy consumption and low wear both on the seal slide ring 34 and on the frame slide ring 38. It also minimizes the risk that the seal slide ring 34 might jam firmly to the frame slide ring 38 with consequent damage to the seal bellows 32.

As in the embodiment described above with reference to FIGS. 1-2, a guiding edge 46 serves as a guiding protrusion which limits transverse movements of the seal slide ring 34 in the horizontal plane. The guiding edge 46 extends downwards from the seal slide ring 34 and runs around the whole circumference of the frame slide ring 38. The inside diameter D1 (FIG. 3) of the guiding edge 46 preferably exceeds the outside diameter D2 of the frame slide ring 38 by less than 5 mm, so that as little dust as possible is allowed to reach the slide surfaces 42, 44. The wear on the slide surfaces 42, 44 is thus limited. It is further preferred, for the same reason, that the guiding edge 46 of the seal slide ring 34 should have a vertical extent of at least 5 mm along the outer shell surface of the frame slide ring 38.

FIGS. 3-4 depict also two safety elements, for safety of the seal slide ring 34, in the form of a pair of retractable safety hooks 56. Each of the safety hooks 56 is provided with a protruding safety portion 58 intended, during operation of the crusher 1, to grip about an upper surface 60 of the seal slide ring 34 and thereby limit how high the seal slide ring 34 might rise from the upper slide surface 44 of the frame, e.g. during unforeseen events such as impacts and shocks from material being crushed. The safety hooks 56 are not necessary for the function of the dust seal 30, but one, two or more safety hooks 56 will help to reduce the risk that the engagement of the seal slide ring 34 with the frame 4 by means of the guiding edge 46 might be inadequate.

Each safety hook 56 is arranged to pivot in a bracket 66 relative to the frame 4 via a journal 62. Each of the safety hooks 56 is pivotable about its journal 62 between the engaged operative state depicted in continuous lines in FIGS. 3-4 and a lowered service state depicted in broken lines in FIG. 4. A key hole 64 through both the safety hook 56 and its bracket 66 is intended, in the operative state, to accommodate an (undepicted) key which may be locked by, for example, an (undepicted) fusible safety device. These holes 64 thus serve as locking devices to lock the safety hooks 56 in the operative state. For optimum friction characteristics and least possible wear it is preferable that the safety portion 58 of the safety hooks 56 in the operative state be clear of the upper surface 60 of the seal slide ring 34.

Safety of the seal slide ring 34 may also be achieved by some other form of guiding protrusion which engages in, for example, a groove in the outer shell surface of the seal slide ring.

The dust seal 30 described above allows a particularly simple fitting procedure. When the crusher head 12 is removed from the crusher 1, the dust seal 30 can be drawn onto the crusher main shaft 2 with the seal slide ring 34 facing downwards, after which the guiding edge 46 of the seal slide ring 34 can easily be centered relative to the outer shell surface of the frame slide ring 38 so that the seal slide ring 34 slides into position and the slide surfaces 42, 44 meet. The upper portion 36 of the seal bellows 32 can then be connected to the crusher main shaft 2 or, after the crusher head 12 has been refitted, to the crusher head 12. The centering of the seal slide ring 34 therefore need not be done at the same time as fitting the heavy crusher head 12 but may take place as a separate step. The risk of pinch accidents during centering is therefore very slight.

It will be appreciated that many variants of the embodiments described above are possible within the scope of the invention.

For example, in the above description the seal bellows 32 is fastened by hose clips 40, 35 to the seal slide ring 34 and to a fastening portion 37, 52 situated close to the crusher head 12. Other forms of connection may be used, such as adhesive bonding or threaded, shape-dictated or frictional connections achieved by elasticity, type of surface and diameter of the bellows 32, which is then held in place entirely by friction or clamps firmly like a rubber band.

The invention has also been illustrated with reference to a crusher 1 with a hydraulically raised and lowered crusher head 12. The invention is also applicable to crushers with other arrangements for raising and lowering the crusher head 12, and to crushers without a raisable and lowerable crusher head, with or without other kinds of arrangements for adjusting the width of the crushing aperture 20, e.g. by raising and lowering the second crushing shell 18.

Also, the invention is not confined to crushers which have a crusher main shaft 2 journalled for rotation in an eccentric 10. It is also suited to crushers which have a fixed crusher head shaft about which the crusher head is journalled for eccentric rotation.

In the above description, the upper portion 36 of the seal bellows 32 is directly connected to a fastening portion 37, 52 close to the crusher head 12. The upper portion 36 of the seal bellows 32 may also be dust-tightly connected indirectly to the fastening portion via some other component, e.g. by the upper portion 36 of the seal bellows 32 being provided with a connecting ring for connecting the seal bellows 32 to the fastening portion 37, 52.

Although the various seal bellows illustrated in the drawings have wavy shell surfaces, a plain seal bellows with no waviness, e.g. a sleeve of dust-tight textile material or an elastic rubber sleeve, is also within the scope of the invention.

The guiding protrusion to limit radial movements of the seal slide ring 34 need not be in the form of a continuous guiding edge 46 around the seal slide ring 34. The crusher 1 may instead be provided with, for example, a plurality of discrete protrusions which extend upwards from the frame to above the slide surfaces 42, 44 within and/or outside the seal slide ring 34, to limit accordingly radial movements of the seal slide ring 34.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A gyratory crusher comprising:

a crusher head on which a first crushing shell is mounted;

a frame on which a second crushing shell is mounted, the second crushing shell forming in conjunction with the first crushing shell a crushing aperture;

a drive device adapted to rotate an eccentric to which the crusher head is so connected as to be caused, during rotation of the eccentric, to perform a gyratory movement for crushing of material which is introduced into the crushing aperture; and a dust seal adapted to seal a gap between a portion of the frame surrounding the eccentric and a fastening portion located on the crusher head or located on a crusher main shaft axially below the crusher head, wherein the dust seal comprises a seal bellows and a seal slide ring which is connected sealingly to a lower portion of the seal bellows and which has a lower slide surface adapted to slide along, and to sealingly abut, with a substantially vertical abutment pressure determined by the inherent weight of the seal slide ring and by the influence of the seal bellows, against an upper slide surface provided on the portion of the frame surrounding the eccentric, with an upper portion of the seal bellows sealingly connected to the fastening portion, so that rotation of the crusher head causes rotation of the seal slide ring about a substantially vertical axis of rotation.

2. A gyratory crusher according to claim 1, wherein mobility of the seal slide ring in radial directions relative to its axis of rotation is limited by a protrusion that prevents the seal slide ring from sliding off the upper slide surface of the frame during operation of the crusher.

3. A gyratory crusher according to claim 2, wherein the frame's upper slide surface is situated on a frame slide ring which extends upwards from the frame, and the protrusion takes the form of a guiding edge which runs along the seal slide ring and is concentric with, and extends downwards around, an upper portion of the frame slide ring, so that the frame slide ring and the guiding edge of the seal slide ring cooperate to limit radial movements of the seal slide ring.

4. A gyratory crusher comprising:

a crusher head on which a first crushing shell is mounted;

a frame on which a second crushing shell is mounted, the second crushing shell forming in conjunction with the first crushing shell a crushing aperture;

a drive device adapted to rotate an eccentric to which the crusher head is so connected as to be caused, during rotation of the eccentric, to perform a gyratory movement for crushing of material which is introduced into the crushing aperture; and a dust seal adapted to seal a gap between a portion of the frame surrounding the eccentric and a fastening portion located on the crusher head or located on a crusher main shaft axially below the crusher head, wherein the dust seal comprises a seal bellows and a seal slide ring which is connected sealingly to a lower portion of the seal bellows and which has a lower slide surface adapted to slide along, and to sealingly abut, with a substantially vertical abutment pressure determined by the inherent weight of the seal slide ring and by the influence of the seal bellows, against an upper slide surface provided on the portion of the frame surrounding the eccentric, with an upper portion of the seal bellows sealingly connected to the fastening portion, so that rotation of the crusher head causes rotation of the seal slide ring about a substantially vertical axis of rotation, wherein mobility of the seal slide ring in radial directions relative to its axis of rotation is limited by a protrusion that prevents the seal slide ring from sliding off the upper slide surface of the frame during operation of the crusher, and wherein mobility of the seal slide ring in axial directions when the crusher is in operation is limited by a safety element situated above a surface of the seal slide ring, and the vertical distance between the safety element and the seal slide ring is appropriate to prevent the seal slide ring from rising so high that the radially limiting action of the protrusion ceases.

5. A gyratory crusher according to claim 4, wherein the safety element comprises a safety hook attached to the frame and pivotable between a lowered service state in which the seal slide ring is free to rise from the frame, and a raised operative state in which the safety hook surrounds an upper surface of the seal slide ring, the safety hook being further provided with a locking device to lock the safety hook in the operative state.

6. A gyratory crusher according to claim 1, wherein the width of the crushing aperture is adjustable by adjustment of the working height of the crusher head.

7. A gyratory crusher according to claim 1, wherein the seal bellows is adapted to absorb vertical movements of the crusher head of at least 100 mm with no loss of tightness.

8. A gyratory crusher according to claim 1, wherein the seal bellows comprises a sealing layer of natural or synthetic rubber.

9. A gyratory crusher according to claim 1, wherein the seal bellows is tangentially stiffened by reinforcing inserts.

10. A gyratory crusher according to claim 1, wherein the seal slide ring is made of nylon.

11. A dust seal of a vertical gyratory crusher for sealing a gap in the gyratory crusher between a frame and a fastening portion located on a vertical crusher main shaft proximate to and axially below a crusher head, comprising:

a seal bellows with a first end opening adapted to sealingly connect to a fastening portion located on the vertical crusher main shaft proximate to and axially below the crusher head, and a second end opening to which a seal slide ring is sealingly connected;

a slide surface which faces away from the seal bellows and is adapted to slide along, and sealingly abut against, a slide surface provided on a portion of the frame surrounding an eccentric that is connected to the crusher head; and a guiding edge which extends from the seal bellows, runs along the seal slide ring and is adapted to cooperate with a frame slide ring attached to the frame, in order to limit transverse movements of the seal slide ring in the plane of the slide surfaces.

12. A gyratory crusher according to claim 1, wherein the dust seal is lubricant free.

13. A gyratory crusher according to claim 4, wherein the dust seal is lubricant free.

* * * * *